US007954264B1

(12) United States Patent
Jost

(10) Patent No.: US 7,954,264 B1
(45) Date of Patent: Jun. 7, 2011

(54) DECORATIVE REFLECTIVE SPINNING DEVICE

(76) Inventor: David E. Jost, Berkeley, CA (US)

( * ) Notice: Subject to any disclaimer, the term of this patent is extended or adjusted under 35 U.S.C. 154(b) by 1208 days.

(21) Appl. No.: 11/498,033

(22) Filed: Aug. 2, 2006

(51) Int. Cl.
*G09F 13/00* (2006.01)

(52) U.S. Cl. ..... 40/431; 446/236; 428/7

(58) Field of Classification Search ..... 40/406, 40/431; 446/236–259, 264, 288, 36
See application file for complete search history.

(56) References Cited

U.S. PATENT DOCUMENTS 1,619,630 A * 3/1927 Pajeau ..... 446/266
3,533,187 A * 10/1970 Campbell ..... 446/233
4,214,808 A 7/1980 Hampton
5,613,799 A 3/1997 Guide
6,422,910 B1 * 7/2002 Takaya ..... 446/139
6,769,951 B2 8/2004 Collier
6,774,299 B2 8/2004 Ford
6,913,506 B2 7/2005 Tiefel
7,018,263 B2 3/2006 Tiefel
7,063,589 B2 6/2006 Matsukawa

* cited by examiner

*Primary Examiner* — Joanne Silbermann
*Assistant Examiner* — Shin Kim
(74) *Attorney, Agent, or Firm* — Cascio & Zervas

(57) ABSTRACT

A solar power ornamental device that features spinning, expandable decorative element displays a constantly changing array of colors when light is reflected from the rotating decorative element. The ornamental display includes: (a) a mounting assembly that includes a base that is rotatable about an axis; (b) means for rotating the rotatable base; and (c) an expandable decorative element that is secured to the rotatable base whereby the expandable decorative element is radially expandable when subjected to centrifugal forces that develop when the rotatable base is rotated.

28 Claims, 4 Drawing Sheets

DECORATIVE REFLECTIVE SPINNING DEVICE

FIELD OF THE INVENTION

The invention is directed to an ornamental spinning apparatus that imparts a brilliant, ever-changing display of flashing colors that is created as light is reflected, refracted, or otherwise illuminated from the surfaces of a decorative rotating element. The novel apparatus can be solar powered for energy efficiency and be designed as an ornamental display kit that features a drive unit, mounting assembly and multiple decorative rotating elements with each rotating element incorporating a different decorative design. Each of the decorative rotating elements is releasably attachable to the mounting assembly so that the elements can be readily interchanged as desired.

BACKGROUND OF THE INVENTION

Conventional indoor and outdoor display devices such as mobiles, wind chimes and mirrored balls become rather lackluster, static or repetitive in just a short time and thereafter are relegated to an obscure corner of a room or backyard. The entertainment value of current display items is minimal given that once a display is configured the visual effects of the display are fixed. The industry is in search of exciting novelty items which afford visual aesthetics with a degree of unpredictability in its presentation. Particularly desired are novelty items that exhibit a robust, environmentally integrated display that is derived from the use of materials that interact with external light and other natural elements.

SUMMARY OF THE INVENTION

The present invention is directed to a device where the visual display is in large part created by forms, colors, and kinetic motion resulting from an engineered confluence of light and light reflective materials with the physical laws of centrifugal motion. The present invention is based, in part, on the development of an ornamental device that has an expandable decorative element which imparts a constantly changing display of colors as light is reflected from the centrifugally generated spinning decorative element. In addition, the device features a coincident display of a selected logo, mascot depiction or design as a personal expression or as advertisement.

The spinning motion adds another dimension to the novelty of the apparatus as the movement creates a unique interplay between the decorative element and sunlight. In the case where the ornamental device is deployed outdoors, the presence of the wind introduces another element as the device is also swayed in different directions by the shifting wind. The ornamental element can be decorated with various visual patterns including, for example, holographic images, reflective ornamentation, distinctive coloration, lights, insignias, licensed characters, other special visual effects and/or other notable styles or features.

In one aspect, the invention is directed to an ornamental display that includes:

(a) a mounting assembly that includes a base that is rotatable about an axis;

(b) means for rotating the rotatable base; and (c) an expandable decorative element that is secured to the rotatable base whereby the expandable decorative element is radially expandable when subjected to centrifugal forces that develop when the rotatable base is rotated.

In another aspect, the invention is directed to a solar powered ornamental display that reflects sunlight to generate continuously changing light patterns that includes:

(a) a mounting assembly that includes a base that is rotatable about an axis;

(b) an expandable decorative element that is secured to the rotatable base wherein the decorative element comprises a proximal portion to which first ends of a plurality of elongated strips are attached and a distal portion to which second ends of a plurality of elongated strips are attached; and (c) an electric motor, that is driven by electricity generated by one or more photovoltaic cells, which is operatively connected to the rotatable base such that operation of the electric motor causes the rotatable base to rotate at a speed sufficient to cause the expandable decorative element to expand in the radial direction when subjected to a centrifugal force that develops when the rotatable base is rotated about a central axis.

In a further aspect, the invention is directed to an ornamental display kit that includes:

(a) a mounting assembly that includes a base that is rotatable about an axis;

(b) means for rotating the rotatable base; and (c) a plurality of expandable decorative elements each of which comprises a proximal portion that can be releasably attachable to the rotatable base and a distal portion and flexible material having first and second ends that are attached to the proximal and distal portions, respectively, whereby when an expandable decorative element is attached to the rotatable base centrifugal forces that develop when the rotatable base is rotated will cause the expandable decorative element to expand radially to attain a spherical shaped contour whereby reflective materials on the flexible material reflects light to create a continuously changing display of color patterns.

DETAILED DESCRIPTION OF THE PREFERRED EMBODIMENTS

Figure 1:
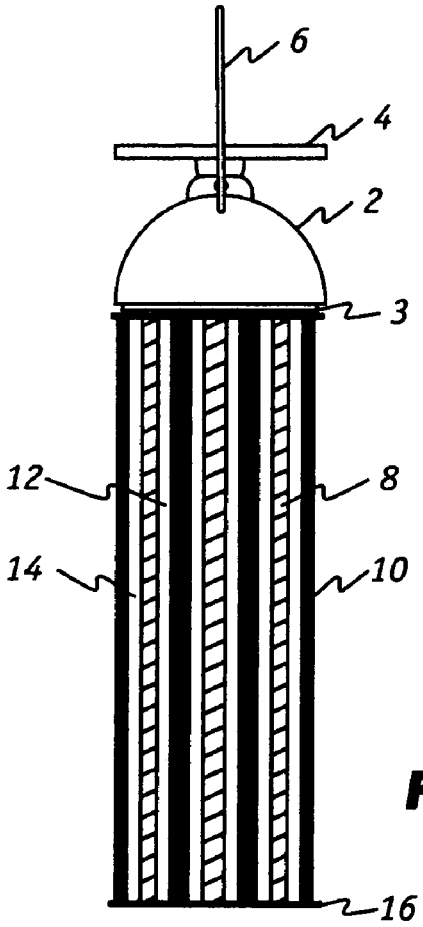
FIG. 1 is a side elevational view of the decorative reflective spinning device.

As shown in FIG. 1, the decorative reflective spinning device includes a housing 2 that has a rotatable base 3 onto which a plurality of decorative strips are attached. In this embodiment, the strips are suspended from rotatable base 3 such that strips made of two different types of materials are arranged to form an alternating pattern. Specifically, strip 8 is made of one type of material and strip 10 is made of another. The strips are spaced laterally or horizontally apart from each other so that each strip is flanked by gaps 12, 14. In one embodiment, the lengths of the strips are the same and the lower ends of the strips are secured to a light-weight stationary member 16. An adjustable solar panel 4 is pivotally mounted to the upper surface of housing 2. A hook 6 that is connected to housing 2 can be used to suspend the decorative reflective spinning device when in use.

Figure 2:
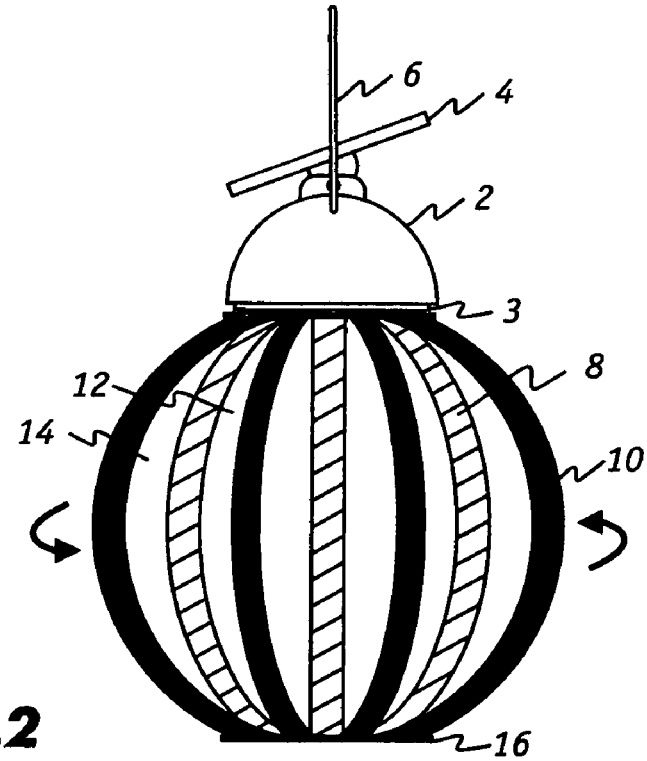
FIG. 2 shows the spinning device in operation.

In operation, the decorative reflective spinning device when powered by photovoltaic cells on the solar panel is hung with hook 6 to an appropriate location that is exposed to sufficient sunlight to operate the photovoltaic cells. As shown in FIG. 2, the position of solar panel 4 is adjusted so as to face the sun thereby generating sufficient energy to drive a motor within housing 2 that in turn causes rotatable base 3 to turn around a central axis. The centrifugal force that results causes the strips 8, 10 to pull away from the central axis but because the ends of the strips are attached to stationary member 16, the outer contour that is formed by the plurality of strips as they spin resembles an ellipse as shown. As is apparent, the vertical distance between rotatable base 3 and stationary member 16 decreases. If rotatable base 3 spins at a constant speed, the shape of the contour remains essentially the same as equilibrium is established between the centrifugal force and restoring forces, e.g., gravity. However, should the speed change or fluctuate, the shape of the contour will be modified in response.

In another embodiment, the strips of the expandable decorative element are not all the same length. For example, referring to FIG. 1, the expandable decorative element can comprise strips made of two types of materials, such as: (1) a reflective holographic material that is used to form a set of primary strips 8 and (2) colored cloth that is used to form a set of secondary (or alternating) strips 10. As shown, the primary and secondary strips are arranged in a circular pattern with an alternating sequence in which each primary strip 8 is flanked by secondary strips and vice-versa. As an example, each primary strip can be 7 inches (18.8 cm) long and each secondary strip can be 6 inches (15.2 cm) long. In operation, when the decorative reflective spinning device is activated, this duel "sets" of strips create two ellipses. A reflective outer "bubble" and a colored inner "bubble.

The plurality of strips of material in the decorative reflective spinning device shown in FIGS. 1 and 2 form part of an expandable decorative element which is generally defined as an apparatus that has an upper end and a lower end that are spaced apart when the expandable decorative element is in used. A plurality of flexible, elongated strips or ribbons of material is attached to the two ends. The number of strips used is not critical; typically the number ranges from 6 to 18 and preferably from 10 to 14. In a preferred embodiment, 12 strips are used: 6 made of one material and 6 of another material that are deployed in an alternating arrangement.

In use, the upper end of the expandable decorative element is attached to a rotatable device so that the plurality of flexible strips is suspended from the upper end. The upper end and the lower end are not connected by a rigid rod or any other device that would restrict the movement of the two ends in the vertical direction relative to each other. As the upper end is rotated, the strips expand radially as a centrifugal force develops but the presence of the lower stationary end limits the extent to which the strips can expand. Since there is no rigid rod that connects the upper and lower ends, the distance between the ends actually decreases as the centrifugal force increases with the speed of rotation. The exterior contour of the expandable decorative elements can form an ellipse or globe. When the rotation stops, the expandable decorative element will contract and the lower end will settle back to its original position.

The individual strips can be made from a variety of materials and colors. Suitable materials include, for example, cloth, paper, and plastic, and combinations thereof. Moreover, reflective materials can be incorporated to accent the strips on the exterior and/or interior surface of the strips. For example, holographic tape and glitter paper can be used. Reflective patterns on the strips will create an ever changing complex visual display especially when operating outdoors as the sunlight reflects off the reflective patterns. In addition, different colors can be used to capture different motifs and themes. For example, the distinctive colors and designs of flags representing different countries can be used. Holiday and festive scenes can be portrayed on the outer surfaces of the strips.

Figure 3:
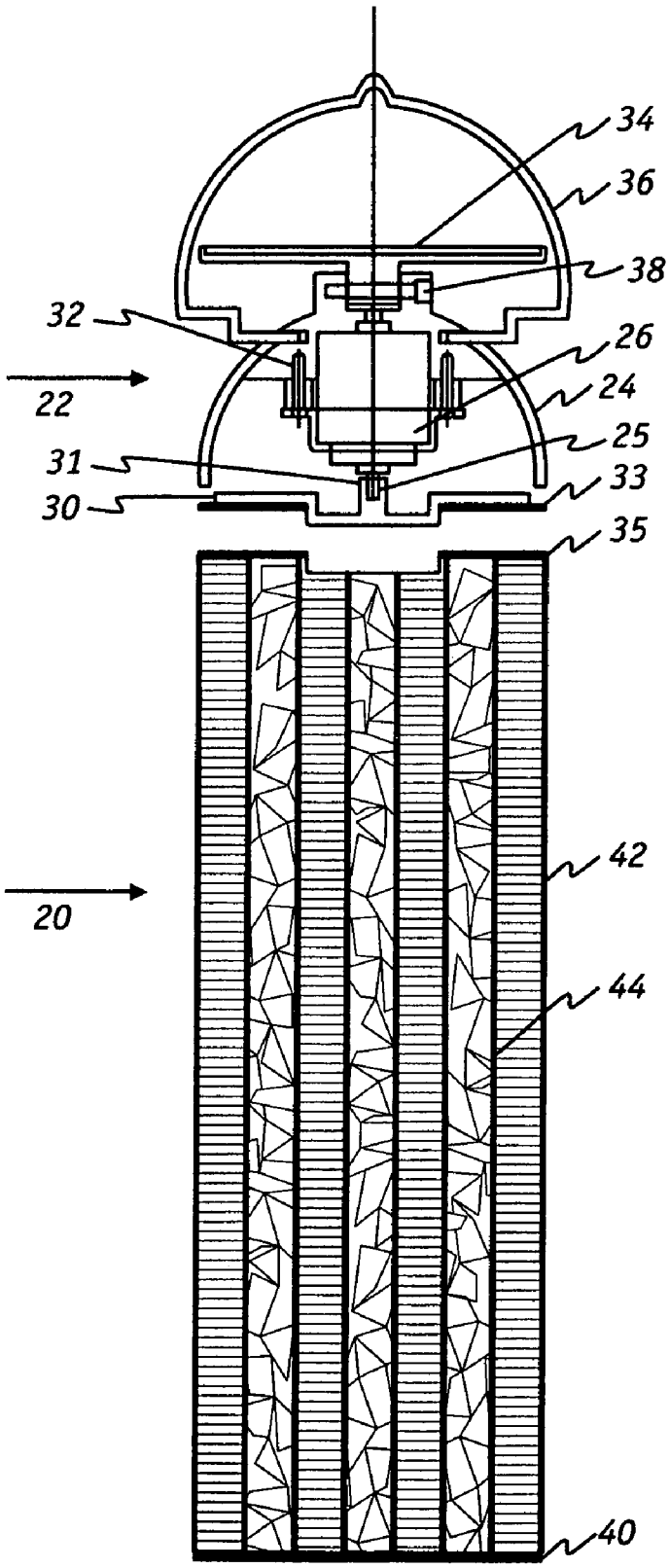
FIG. 3 is a cross-sectional view of the spinning device illustrating the mounting assembly and the expandable decorative element.

FIG. 3 is a cross-sectional view of the decorative reflective spinning device with an expandable decorative element 20 detached from a mounting assembly 22, which includes housing 24 that enshrouds an electric motor 26. Electric motor 26 has flanges through which screws 32 are inserted to secure the electric motor 26 inside housing 24. Electric motor 26 is mounted so that its motor shaft 25 is directed downward along the central axis of mounting assembly 22 and is coupled to a cavity 31 at the center of base plate 30 which is preferably made of a strong, light weight plastic material. Coupling plate 33, which is made of steel or other material that is attracted to magnets, is configured as a flat disk is adhered, e.g., glued, to the lower surface of base plate 30. The flat disk has an opening that accommodates the protrusion on the lower surface of base plate 30. The protrusion serves as a self-centering guide so that the flat disk coupling plate 33 will be properly aligned with the central axis as it is glued to base plate 30. When electric motor 26 is activated, the torque generated by rotating motor shaft 25 rotates or spins the base plate 30/coupling plate 33 assembly.

Electric motor 26 is preferably a DC motor that is powered by photovoltaic or solar cells that form solar panel 34 that is pivotally mounted to the upper portion of housing 24 with bolt 38. Alternatively, batteries can be used. A hook 36 is attached to the upper portion of housing 24. Electric motor 26 and the other components of mounting assembly 22 are configured and arranged so that their weights are distributed evenly about the central axis. In this balanced or symmetrical arrangement, when motor shaft 25 rotates, the wobbling of mounting assembly 22 will be minimized.

Decorative element 20 includes an attachment plate 35 and stationary member 40. The attachment plate 35 is a conventional permanent magnet, e.g., ferromagnet, which will be attracted to coupling plate 33. In a preferred embodiment, attachment plate 35 is also configured as a flat disk with an outer contour that becomes flushed with that of coupling plate 33. In addition, an aperture in the center of the flat disk attachment plate 35 also facilitates proper alignment. The decorative element includes two sets of strips 42 and 44 that are arranged alternatively. In the arrangement shown in FIG. 3, there is essentially no gap between adjacent strips. The lower ends of the strips are attached to stationary member 40 that is configured as a flat disk with a diameter that is the same as that of attachment plate 35.

Figure 4:
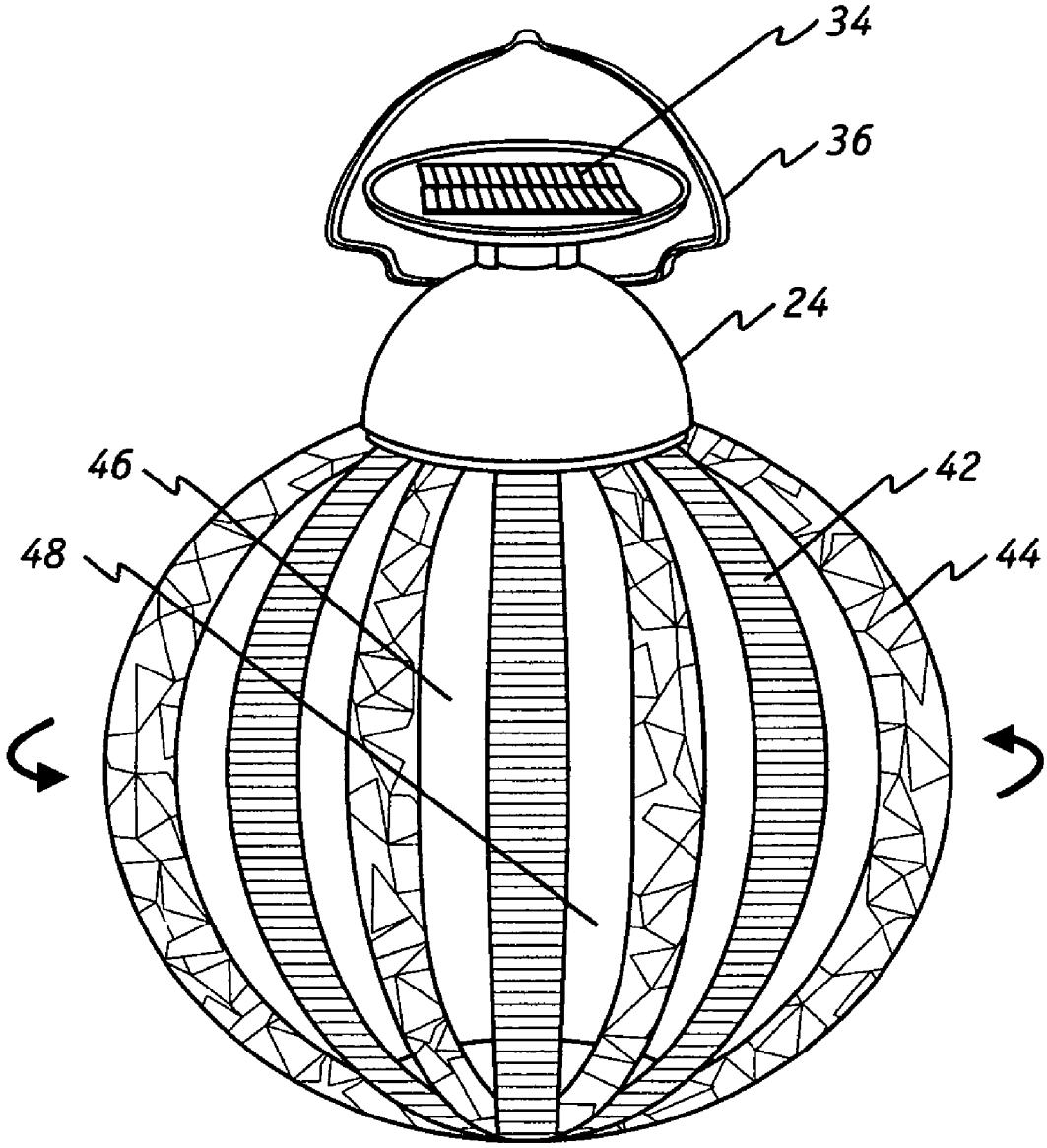
FIG. 4 shows the spinning device in operation as powered by photovoltaic cells.

The decorative element 20 shown in FIG. 3 is detachable from the mounting assembly 22. In this fashion, one mounting assembly 22 can accommodate many expandable decorative elements encompassing various designs that are part of a kit. In use, a person selects one of the expandable decorative elements from the kit and attaches it to the mounting assembly. FIG. 4 shows an assembled decorative reflective spinning device with the expandable decorative element spinning about a central axis and forming an elliptical exterior pattern. Gaps 46, 48 which develop between the strips allow sunlight to shine into the interior of the expandable decorative element. Thus, light will be reflected from the interior surfaces of the strips as well as the exterior surfaces.

Figure 5:
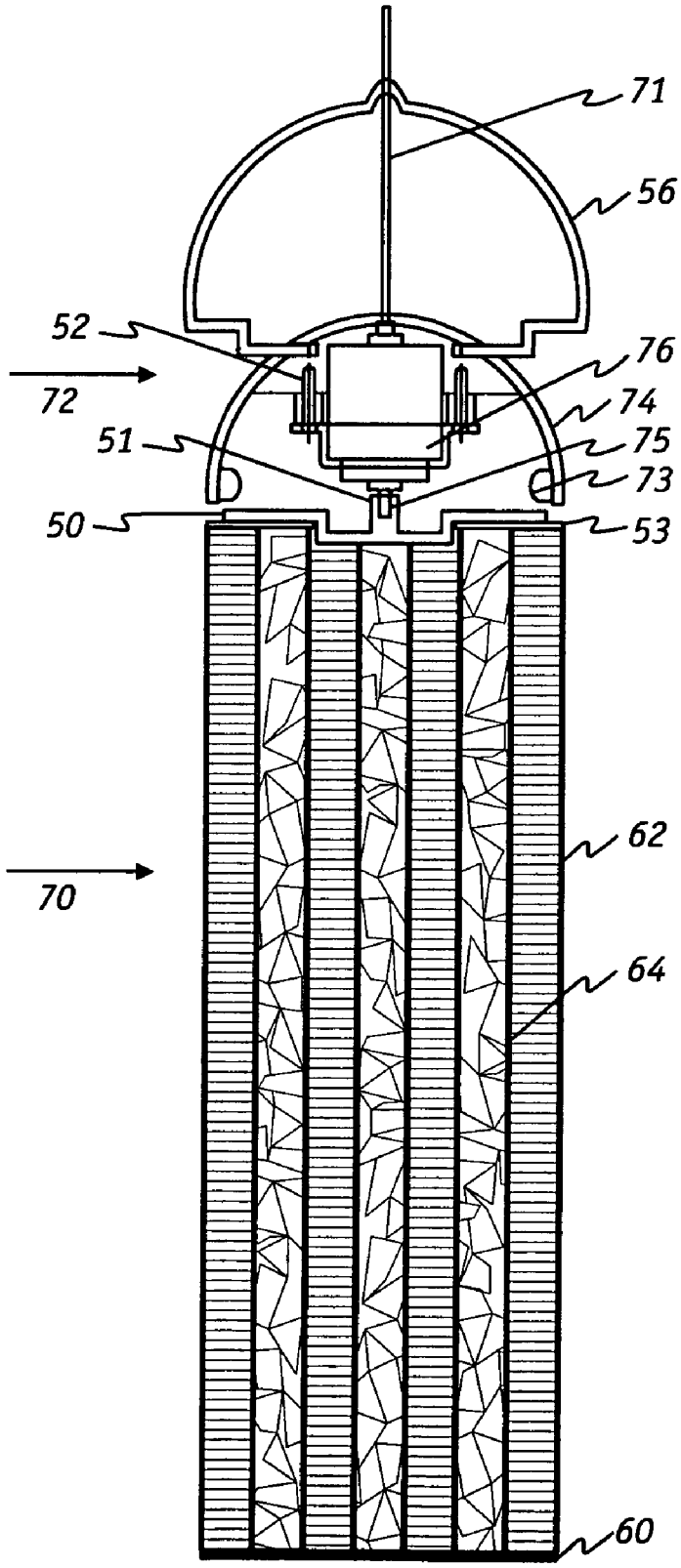
FIG. 5 is a cross-sectional view of another spinning device.

FIG. 5 is a cross-sectional view of another embodiment of the decorative reflective spinning device with an expandable decorative element 70 attached to a mounting assembly 72, which includes housing 74 that enshrouds an electric motor 76. Electric motor 76 has flanges through which screws 52 are inserted to secure the electric motor 76 inside housing 74, which has an interior surface that is preferably made of a reflective material such as polished aluminum. Electric motor 76 is mounted so that its motor shaft 75 is directed downward along the central axis of mounting assembly 72 and is coupled to a cavity 51 at the center of base plate 50 which is preferably made of a strong, light weight clear plastic material. The base plate 50 has a protrusion on the lower surface that serves as a self-centering guide for attachment plate 53. When electric motor 76 is activated, the torque generated by rotating motor shaft 75 rotates or spins the base plate 50.

This embodiment of the spinner device, which is particularly suited for use at night or indoors, includes an internal light source 73 that can comprise one or more light bulbs, laser diodes, or other conventional lighting devices. The internal light source 73 can be positioned at any strategic location in order to illuminate decorative element 70; as illustrated, the light source 73 is mounted on the inner surface of housing 74. When it is activated, light will be reflected from the reflective interior surface of housing 74 and transmitted through the clear plastic of base plate 50 and into decorative element 70. The internal illumination creates a glow of color from within the decorative element 70 that simulates a lamp or lantern.

Internal light source 73 and electric motor 76 are powered by alternating current that is supplied through electric wire 71. Alternatively, batteries can be used. A hook 56 is attached to the upper portion of housing 74. Decorative element 70 includes an attachment plate 53 and stationary member 60. The attachment plate 53 is made of clear plastic and can be permanently attached to base plate 50 with glue or other conventional means. Alternatively, attachment plate 53 and base plate 50 can be fabricated as an integrated unit.

Still alternatively, attachment plate 53 and base plate 50 can be separate parts that are releaseably connected with screws, clamps or other means. In this fashion, different decorative elements 70 from an ornamental display kit can be interchanged as desired. When attachment plate 53 and base plate 50 are detachable, attachment plate 53 is configured as a flat disk that has an aperture in the center of the flat disk to facilitate proper alignment with the protrusion of the base plate 50.

The decorative element includes two sets of strips 62 and 64 that are arranged alternatively. The lower ends of the strips are attached to stationary member 40 that is configured as a flat disk with a diameter that is the same as that of attachment plate 53. In operation, the exterior contour of decorative element 70 of the spinning device will be the same as that shown in FIG. 4 however, with the internal light source 73, this spinning device will also develop a glow emanating from within the decorative element 70. At the same time, the internal illumination is also interacts with various visual patterns including, for example, holographic images, reflective ornamentation, distinctive coloration, lights, insignias, licensed characters, other special visual effects and/or other notable styles or features that adorn strips 62 and 64 of the decorative element.

The foregoing has described the principles, preferred embodiments and modes of operation of the present invention. However, the invention should not be construed as being limited to the particular embodiments discussed. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An ornamental display that comprises:

(a) a mounting assembly that includes a stationary, non-rotating housing and a base that is rotatable about an axis;

(b) an electric motor operatively coupled to the base to impart rotation thereto; and (c) an expandable decorative element, which comprises a plurality of elongated strips of flexible material, with each elongated strip haying an interior surface and exterior surface, and that is secured to the rotatable base whereby the expandable decorative element is radially expandable when subjected to centrifugal forces that develop when the rotatable base is rotated and characterized in that the elongated strips of flexible material attain a generally spherical shape when the speed that the rotatable base is rotated reaches a certain level, the interior surface of each of the strips being substantially non-observable exteriorly of the decorative element while in a non-expanded state and observable exteriorly of the decorative element when the generally spherical shape is attained.

2. The ornamental display of claim 1 further comprising at least one photovoltaic cell that is operatively connected to the electric motor.

3. The ornamental display of claim 1 further comprising one or more light sources that illuminate the expandable decorative element.

4. The ornamental display of claim 1 wherein the elongated strips of flexible material are suspended from the rotatable base.

5. The ornamental display of claim 1 comprising a proximal attachment plate that is secured to the rotatable base and to which first ends of the plurality of elongated strips are attached and a distal lower member to which second ends of the plurality of elongated strips are attached.

6. The ornamental display of claim 5 wherein the proximal attachment plate is magnetically coupled to the rotatable base.

7. The ornamental display of claim 5 wherein the elongated strips of material comprise ribbons that are made of material that is selected from the group consisting of cloth, paper, plastic and combinations thereof.

8. The ornamental display of claim 5 wherein at least one of the elongated strips contains reflective materials.

9. The ornamental display of claim 5 wherein at least one of the elongated strips contains reflective materials on both interior and exterior surfaces.

10. The ornamental display of claim 5 wherein the elongated strips are spaced apart horizontally from each other.

11. The ornamental display of claim 5 wherein the proximal attachment plate and distal member are spaced apart vertically from each other but the ornamental display does not restrict the movement of the distal member.

12. The ornamental display of claim 1 wherein the expandable decorative element expands and contracts radially as the speed that the rotatable base is rotated changes.

13. The ornamental display of claim 1 wherein the plurality of elongated strips of flexible material have different length elongated strips.

14. The ornamental display of claim 1 wherein the expandable decorative element consists essentially of a plurality of elongated strips of flexible material.

15. A solar powered ornamental display that reflects sunlight to generate continuously changing light patterns that comprises:

(a) a mounting assembly, which is configured to be hung, that includes a stationary, non-rotating housing and a base that is rotatable about a central axis;

(b) an expandable decorative element that comprises a plurality of elongated flexible strips having first ends that are secured to the rotatable base and second ends that are secured, wherein each elongated flexible strip has an interior surface and an exterior surface; and (c) an electric motor, that is driven by electricity generated by one or more photovoltaic cells, which is operatively connected to the rotatable base such that operation of the electric motor causes the rotatable base to rotate at a speed sufficient to cause the expandable decorative element to expand in the radial direction when subjected to a centrifugal force that develops when the rotatable base is rotated about the central axis characterized in that when the decorative element expands both the interior and exterior surfaces of each elongated flexible strip interact with the sunlight to impart a constantly changing display of colors with the interior surface of each of the strips being substantially non-observable exteriorly of the decorative element while in a non-expanded state and observable exteriorly of the decorative element when a generally spherical state is attained.

16. The solar powered ornamental display of claim 15 wherein the elongated flexible strips are spaced apart horizontally from each other.

17. The solar powered ornamental display of claim 15 comprising an attachment plate to which the first ends are secured and a lower member to which second ends are secured and wherein the attachment plate and lower member are spaced apart vertically from each other with the proviso that the ornamental display does not restrict the movement of the lower member.

18. The solar powered ornamental display of claim 17 wherein the attachment plate is magnetically coupled to the rotatable base.

19. The solar powered ornamental display of claim 17 wherein the elongated flexible strips comprise ribbons that are made of material that is selected from the group consisting of cloth, paper, plastic and combinations thereof.

20. The solar powered ornamental display of claim 17 wherein at least one of the elongated strips contains reflective materials.

21. The solar powered ornamental display of claim 17 wherein at least one of the elongated strips contains reflective materials on both interior and exterior surfaces.

22. The solar powered ornamental display of claim 15 wherein the expandable decorative element consists essentially of a plurality of elongated strips of flexible material.

23. An ornamental display kit that comprises:

(a) a mounting assembly that includes a stationary, non-rotating housing and a base that is rotatable about an axis:

(b) means for rotating the rotatable base that comprises an electric motor and a source of electric energy comprising one or more photoelectric cells or one or more batteries; and (c) a plurality of expandable decorative elements each of which comprises a plurality of elongated strips of flexible material with each elongated strip haying first ends that are secured to a proximal attachment plate and second ends that are secured to a distal member and wherein each elongated strip has an interior surface and exterior surface, whereby when an expandable decorative element is attached to the rotatable base the plurality of elongated strips is suspended from the proximal attachment plate wherein the proximal attachment plate and distal member are spaced apart vertically from each other with the proviso that the ornamental display does not restrict the movement of the distal member which is held solely by the elongated strips and with the proviso that when centrifugal forces develop when the rotatable base is rotated the expandable decorative element expands radially to attain a spherical shaped contour thereby exposing both the interior and exterior surfaces of each elongated strip whereby reflective materials on the flexible material reflects light to create a continuously changing display of color patterns with the interior surface of each of the strips being substantially non-observable exteriorly of the decorative element while in a non-expanded state and observable exteriorly of the decorative element when a generally spherical state is attained.

24. The ornamental display kit of claim 23 wherein the elongated strips of flexible material comprise ribbons that are made of material that is selected from the group consisting of cloth, paper, plastic and combinations thereof.

25. The ornamental display kit of claim 23 wherein the plurality of elongated strips of flexible material have different length elongated strips.

26. The ornamental display kit of claim 23 further comprising one or more light sources that illuminate an expandable decorative element.

27. The ornamental display kit of claim 26 wherein the proximal attachment plate is magnetic and is detachable from the rotatable base.

28. The ornamental display kit of claim 23 wherein each of the expandable decorative elements consists essentially of a plurality of elongated strips of flexible material.

* * * * *